US008241437B2

(12) United States Patent
Utsunomiya et al.

(10) Patent No.: US 8,241,437 B2
(45) Date of Patent: Aug. 14, 2012

(54) METAL SHEET ROLLING METHOD AND ROLLED SHEET MANUFACTURED BY METAL SHEET ROLLING METHOD

(75) Inventors: Hiroshi Utsunomiya, Suita (JP); Tetsuo Sakai, Toyonaka (JP); Takaya Ueno, Zama (JP); Naokuni Muramatsu, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 378 days.

(21) Appl. No.: 12/547,837

(22) Filed: Aug. 26, 2009

(65) Prior Publication Data

US 2010/0009212 A1 Jan. 14, 2010

Related U.S. Application Data

(63) Continuation of application No. PCT/JP2008/053394, filed on Feb. 27, 2008.

(30) Foreign Application Priority Data

Feb. 27, 2007 (JP) ..... 2007-047158

(51) Int. Cl.
*C22C 28/00* (2006.01)
*B21B 45/02* (2006.01)

(52) U.S. Cl. ..... 148/400; 428/600; 72/41

(58) Field of Classification Search ..... 148/400; 428/600; 72/41
See application file for complete search history.

(56) References Cited

FOREIGN PATENT DOCUMENTS

| | | | |
|---|---|---|---|
| CN | 1191780 | A1 | 9/1998 |
| JP | 53-135861 | A1 | 11/1978 |
| JP | 60-072601 | A1 | 4/1985 |
| JP | 02-251301 | A1 | 10/1990 |
| JP | 03-297504 | A1 | 12/1991 |
| JP | 06-055202 | A1 | 3/1994 |
| JP | 2005-068178 | A1 | 3/2005 |

OTHER PUBLICATIONS

Translated JP02251301, 1990.*
T. Sakai et al., "Introduction of shear strain to aluminum alloy sheet and control of texture," Journal of Japan Institute of Light Metals, 2002, vol. 52, No. 11, pp. 518-523.

* cited by examiner

*Primary Examiner* — Emily Le
*Assistant Examiner* — Rebecca Lee
(74) *Attorney, Agent, or Firm* — Burr & Brown

(57) ABSTRACT

The present invention provides a metal sheet rolling method of rolling a metal sheet with a pair of rolls, as well as a rolled sheet manufactured by the metal sheet rolling method. In the metal sheet rolling method, respective interfaces between the pair of rolls and the metal sheet have mutually different frictions. Additionally at least one of the interfaces may be lubricated by a procedure other than lubrication by coating of a liquid lubricant agent. Alternatively at least one of the interfaces may be subjected to surface treatment by a procedure other than lubrication, or otherwise the pair of rolls may be made of mutually different materials.

19 Claims, 8 Drawing Sheets

{111} Pole Figure

Working Example 29

Comparative Example 5

(Comparative Example 4 had the same result as Comparative Example 3).

METAL SHEET ROLLING METHOD AND ROLLED SHEET MANUFACTURED BY METAL SHEET ROLLING METHOD

FIELD OF THE INVENTION

The present invention relates to a metal sheet rolling method and a rolled sheet manufactured by the metal sheet rolling method.

BACKGROUND OF THE INVENTION

Plastic working causes crystalline grains of a polycrystalline metal material not to be oriented at random but to be statistically oriented in a specific orientation (preferred orientation) and develops the texture. The texture formed in a worked metal sheet by rolling is called rolling texture.

Another texture formed in the worked metal sheet is shear texture, which may be preferred over the rolling texture. As is known in the art, development of the shear texture improves the press formability (deep drawability) in aluminum alloy materials, the ductility in magnesium alloy materials, and the bend formability in copper alloy materials. Development of the shear texture also causes an easy direction of magnetization <001> to be orientated in parallel with a rolling direction in iron and steel materials.

The conventional rolling technique, however, introduces the shear texture only to the shallow surfaces of a resulting rolled metal sheet (hereafter referred to as 'rolled sheet') by the friction with rolls and does not succeed in sufficiently developing the shear texture into the sheet thickness of the rolled sheet. The conventional rolling technique accordingly does not exert the effects of the developed shear texture explained above.

A differential speed rolling technique of rotating a pair of an upper roll and a lower roll at mutually different speeds is adopted to introduce the shear deformation into the sheet throughout the thickness of the rolled sheet and develop the shear texture into the sheet throughout the thickness of the rolled sheet (see Non-Patent Document 1).

In order to reduce the rolling load, one proposed rolling technique rolls a metal sheet by differentiating between the lubricating oil quantities or the lubricating oil compositions of a liquid lubricant agent fed to an upper surface and to a lower surface of the metal sheet to make the friction coefficient of the metal sheet relative to an upper roll different from the friction coefficient of the metal sheet relative to a lower roll (see Patent Document 1). Namely this rolling technique rolls the metal sheet in the state of mutually differentiating between the lubricating oil quantities or the lubricating oil compositions fed to respective interfaces between the pair of rolls and the metal sheet to make the different friction coefficients on the respective interfaces.

Non-Patent Document 1: Tetsuo Sakai, Hiroshi Utsunomiya, and Yoshihiro Saito, 'Introduction of Shear Strain to Aluminum Sheet and Control of Texture', Kei-Kinzoku (Journal of Japan Institute of Light Metals), Japan Institute of Light Metals, November 2002, Vol. 52, No. 11, pp. 518 to 523

Patent Document 1: Japanese Patent Laid-Open No. Sho53-135861

SUMMARY OF THE INVENTION

The differential speed rolling technique requires a special rolling mill (differential speed rolling mill) with a mechanism of independently driving each roll in a pair of rolls. The differential speed rolling mill has a mechanism of the higher intricacy and of the higher complexity and thereby requires the higher cost, compared with a conventional rolling mill (constant speed rolling mill) of rotating a pair of rolls at an identical speed. In practice, the differential speed rolling mill accordingly has an extremely limited range of applications.

The rolling technique disclosed in Patent Document 1 uses the liquid lubricant agent and makes both the upper interface and the lower interface in the low friction state of fluid film lubrication or mixed lubrication. Namely this rolling technique is effective for reduction of the rolling load but fails to significantly differentiate between the frictions of the upper and the lower interfaces. This causes the introduced shear deformation to remain in the shallow surfaces of the sheet thickness and does not sufficiently develop the shear texture into the sheet throughout the thickness of the metal sheet. The use of the different lubricating oil compositions fed to the upper interface and the lower interface causes the lubricating oil to be shifted from one side of the sheet width of the metal sheet to the other side during idling before and after rolling of the metal sheet or in the course of rolling. Such a shift of the lubricating oil interferes with significantly differentiating between the frictions of the upper and the lower interfaces. In addition, separate recovery of the lubricating oils by the different compositions is of extreme difficulty. The lubricating oils can thus be not recycled or reused. There would thus be a need for the disposal of the lubricating oils or for separation of the recovered lubricating oil into the lubricating oils of the two different compositions. The disposal or the separate recovery is, however, extremely undesirable both economically and technically.

There would thus be a demand for providing a metal sheet rolling method that enables even a conventional rolling mill of rotating a pair of rolls at an identical speed to sufficiently introduce shear deformation into a thickness of a rolled sheet and develop a shear texture into the center of the thickness of the rolled sheet, which are generally attainable by the differential speed rolling mill, as well as a demand for providing a rolled sheet manufactured by such a rolling method.

In order to solve the problems of the prior art discussed above, the inventors of the present invention have noted the principle of introducing shear deformation into a metal sheet and have been dedicated to research and investigation. As the result, the inventors have completed the invention based on the finding that application of a procedure other than lubrication by coating of a liquid lubricant agent to mutually differentiate between the frictions of respective interfaces between a pair of rolls and a metal sheet enables even a conventional rolling mill of rotating the pair of rolls at an identical speed to introduce shear deformation deep into the center of the sheet thickness of a resulting rolled sheet and sufficiently develop shear texture in the resulting rolled sheet.

According to one aspect, the invention is directed to a first metal sheet rolling method of rolling a metal sheet with a pair of rolls. The first metal sheet rolling method mutually differentiates between frictions of respective interfaces between the pair of rolls and the metal sheet and lubricates at least one of the interfaces by a procedure other than lubrication by coating of a liquid lubricant agent. The metal sheet rolling method according to this aspect of the invention enables even a conventional rolling mill of rotating the pair of rolls at an identical speed to introduce shear deformation deep into the center of the sheet thickness of a resulting rolled sheet and sufficiently develop shear texture in the resulting rolled sheet. The metal sheet rolling method according to the above aspect of the invention gives rolled sheets, such as aluminum alloy sheets with excellent formability (deep drawability), magnesium alloy sheets with high ductility, copper alloy sheets with excellent bend formability, and magnetic steel sheets with excellent electromagnetic property, without any significant cost increase.

The principle of introducing shear deformation into the metal sheet is explained below. The rolling technique with a conventional rolling mill of rotating a pair of rolls at an identical speed is described in detail with reference to FIG. 1. This technique rolls the metal sheet symmetrically between the pair of rolls as mentioned previously and may thus be referred to as 'symmetrical rolling technique' in the discussion hereafter. FIG. 1(*a*) shows symmetrical rolling in a low friction state of interfaces between a material 4 (metal sheet) and one pair of upper roll and lower roll (upper roll 1 and lower roll 2). FIG. 1(*b*) shows symmetrical rolling in a high friction state of the interfaces. Rolling pressure distributions 5 between the material 4 and the respective rolls 1 and 2 and deformation of linear elements 3 of the material 4, which are perpendicular to the material 4 prior to rolling are also shown in FIGS. 1(*a*) and 1(*b*).

At an inlet of the rolling mill, the material feed speed is slower than the roll rotation speed, so that the material 4 is drawn in by the frictional force of the rolls 1 and 2. Ends of the linear element 3 on the respective surface sides of the material 4 are slightly bent in a rolling direction from the original perpendicular orientation prior to rolling. Since the material 4 has a constant volume, the material feed speed increases with a decrease in sheet thickness. The material is accordingly discharged from an outlet of the rolling mill at a higher speed than the roll rotation speed. There are specific points where the material feed speed is equal to the roll rotation speed (hereafter referred to as 'neutral points') in the roll bites. Arrows schematically represent frictional force applied on the material 4 by the interfaces of the rolls 1 and 2. The direction of the frictional force is inverted at each neutral point N. The rolling pressure distributions 5 have maximum values at the neutral points N with the highest degree of frictional restriction.

The high friction state of FIG. 1(*b*) has the large frictional force and the large frictional shear force. The degree of shear deformation introduced beneath the material 4 is thus greater in the high friction state of FIG. 1(*b*) than in the low friction state of FIG. 1(*a*). This simultaneously leads to the greater rolling pressure and the increased rolling load. The symmetrical rolling technique, however, introduces the shear deformation only immediate beneath the surfaces of the material 4, irrespective of the magnitude of the friction as shown in FIGS. 1(*a*) and 1(*b*). It is thus, in principle, impossible to introduce the shear deformation into the sheet thickness.

The rolling technique with a differential speed rolling mill is described in detail with reference to FIG. 2. In the condition of FIG. 2, the rotation speed of the lower roll 2 is set to be higher than the rotation speed of the upper roll 1. Since the upper roll 1 and the lower roll 2 have different rotation speeds in the differential speed rolling technique, the neutral point N of the upper roll 1 is not aligned with the neutral point N of the lower roll 2 in the vertical direction. As in the symmetrical rolling technique discussed above, the surfaces of the material receive the shear deformation in the location between the inlet of the rolling mill and the neutral point of the upper roll (the lower-speed roll). The direction of the frictional force across the upper neutral point is inverted to the direction of the frictional force across the lower neutral point. Opposed shear stresses are accordingly applied in an area between the upper neutral point and the lower neutral point. The differential speed rolling technique thus lowers the rolling pressure distributions 5 (friction hills) and decreases the rolling pressure (rolling load), compared with the symmetrical rolling technique.

The presence of this area (cross shear area 7 (opposed shear area)) introduces shear deformation into the sheet throughout the thickness. One end of the linear element 3 on the side of the higher-speed roll 2 is accordingly advanced in the rolling direction from the original perpendicular orientation prior to rolling.

The rolling technique of the invention with a rolling mill having different frictions between a metal sheet and an upper roll and a lower roll (hereafter referred to as 'differential friction rolling') is described in detail with reference to FIG. 3. In the condition of FIG. 3, the upper roll 1 has the low friction and the lower roll 2 has the high friction.

As mentioned above, the neutral points N are aligned in the vertical direction in the symmetrical rolling technique. In the state of different frictions on the interfaces of the upper and the lower rolls in the differential friction rolling technique of the invention, the lower roll 2 would have the greater rolling load than that of the upper roll 1, provided that the neutral points N were aligned in the vertical direction. The difference of the rolling load causes an imbalance of the force in the vertical direction. A shift of the neutral point N on the low friction side to the inlet and a shift of the neutral point N on the high friction side to the outlet attains a force balance.

As in the differential speed rolling technique, there is a cross shear area 7. Both the surfaces of the material 4 receive the frictional shear force in the location between the inlet of the rolling mill and the upper roll (the lower-friction roll). Since the lower interface has the higher friction coefficient, the introduced shear deformation is not symmetrical in the vertical direction but increases in the vicinity of the lower surface. In the cross shear area 7, the opposed shear stresses cause the shear deformation to be introduced into the sheet throughout the thickness as in the differential speed rolling technique. One end of the linear element 3 on the side of the higher-friction roll 2 is accordingly advanced in the rolling direction from the original perpendicular orientation prior to rolling.

As described above, the metal sheet rolling method according to the above aspect of the invention enables even a conventional rolling mill of rotating the pair of rolls at an identical speed to introduce shear deformation into the sheet thickness of the resulting rolled sheet and sufficiently develop shear texture into the center of the sheet thickness of the rolled sheet.

The differential friction rolling technique of the invention introduces shear deformation and gives a resulting rolled sheet with crystal grain structure extended in an inclined direction and shear texture. Unlike the symmetrical rolling technique, the presence of the cross shear area by the differential friction rolling technique lowers the rolling load. Even at an identical rolling reduction rate, the differential friction rolling technique introducing the shear deformation gives the significantly larger equivalent strain and the finer microstructure after annealing than the symmetrical rolling technique.

The metal sheet rolling method of the invention lubricates at least one interface by the procedure other than lubrication by coating of the liquid lubricant agent to mutually differentiate between the frictions of the respective interfaces between the pair of rolls and the metal sheet. This arrangement allows significant differentiation between the frictions of the respective interfaces and ensures the more sufficient development of the shear texture into the sheet thickness, compared with the technique of lubricating both the interfaces by coating of the liquid lubricant agent (see Patent Document 1). The metal sheet rolling method of the invention also does not require any post treatment after coating of the liquid lubricant agent. The procedure other than lubrication by coating of the liquid lubricant agent is, for example, surface treatment of the metal sheet or the rolls as discussed later in detail.

The metal sheet rolling method according to the above aspect of the invention gives rolled sheets, such as aluminum alloy sheets with excellent press formability (deep drawability), magnesium alloy sheets with high ductility, copper alloy sheets with excellent bend formability, and magnetic steel sheets with excellent electromagnetic property suitably applied for transformers with little iron loss, without any significant cost increase.

The differential friction rolling technique of the invention is preferably applicable to the conventional rolling mill of rotating the pair of rolls at an identical speed. The differential friction rolling technique accordingly has the lower cost, the wider application range, the higher potential for practical application, and the longer durability of rolls, compared with the differential speed rolling technique.

In one preferable application of the first metal sheet rolling method according to the above aspect of the invention, the procedure other than lubrication by coating of the liquid lubricant agent is lubrication by film forming of a solid lubricant agent. This arrangement mutually differentiates between the frictions of the respective interfaces between the pair of rolls and the metal sheet to adopt the differential friction rolling technique, thus assuring the effects discussed above. As explained previously, the technique of lubricating both the interfaces by coating of the liquid lubricant agent causes each interface to be in the state of fluid film lubrication or in the state of mixed lubrication. The fluid film lubrication state or the mixed lubrication state does not allow the shear deformation generated beneath the surface of the rolled sheet to be sufficiently introduced into the center of the sheet thickness and interferes development of shear texture into the center of the sheet thickness. The film forming of the solid lubricant agent, on the other hand, causes the interface to be in the state of boundary lubrication without transfer of the lubricant agent to the higher friction side and ensures introduction of shear deformation deep into the center of the sheet thickness. This application of the metal sheet rolling method accordingly has the better effects of the differential friction rolling technique. The differential friction rolling technique of this application enables at least one surface of the metal sheet to be well lubricated and thereby gives the rolled sheet with the better surface property, compared with the differential speed rolling technique.

In one preferable embodiment of the first metal sheet rolling method according to the above aspect of the invention, the solid lubricant agent is a fluororesin lubricant agent. The fluororesin lubricant agent is desirable as the solid lubricant agent. Preferable examples of the fluororesin lubricant agent include a polytetrafluoroethylene (PTFE) lubricant agent, a tetrafluoroethylene-perfluoroalkyl vinyl ether copolymer (PFA) lubricant agent, and a tetrafluoroethylene-hexafluoropropylene copolymer (FEP) lubricant agent. Especially preferable is the polytetrafluoroethylene (PTFE) lubricant agent with the higher easiness of forming a film on the metal surface, the high adhesion property to the base metal, and the good lubrication property.

According to another aspect, the invention is also directed to a second metal sheet rolling method of rolling a metal sheet with a pair of rolls. The second metal sheet rolling method mutually differentiates between frictions of respective interfaces between the pair of rolls and the metal sheet and makes at least one of the interfaces subjected to surface treatment by a procedure other than lubrication. The surface treatment of at least one interface by the procedure other than lubrication mutually differentiates between the frictions of the respective interfaces between the pair or rolls and the metal sheet to adopt the differential friction rolling technique, thus exerting the effects similar to those discussed above. The surface treatment procedure other than lubrication is not specifically restricted but may be, for example, smoothing by polishing, roughening by shotblasting, film forming of, for example, TiC (titanium carbide), and coating of a powdery anti-slipping agent like SiC or $Al_2O_3$.

In one preferable application, either of the first metal sheet rolling method and the second metal sheet rolling method according to the respective aspects of the invention discussed above may mutually differentiate between surface conditions of the pair of rolls. This arrangement mutually differentiates between the frictions of the respective interfaces between the pair of rolls and the metal sheet to adopt the differential friction rolling technique, thus assuring the effects discussed above. This application of the metal sheet rolling method does not require any special surface treatment of the metal sheet and is thus of high efficiency. The technique adopted to mutually differentiate between the surface conditions of the pair of rolls is not specifically restricted but may be any technique of allowing the pair of rolls to have the mutually different surface conditions, for example, plating or smoothing by polishing. The surface of one roll may be subjected to no treatment.

In another preferable application, either of the first metal sheet rolling method and the second metal sheet rolling method according to the respective aspects of the invention discussed above may mutually differentiate between surface conditions of respective surfaces of the metal sheet in contact with the pair of rolls. This arrangement mutually differentiates between the frictions of the respective interfaces between the pair of rolls and the metal sheet to adopt the differential friction rolling technique, thus assuring the effects discussed above. This application of the metal sheet rolling method does not require any special surface treatment of the pair of rolls and accordingly ensures the high versatility of the rolling mill and the easy cleaning of the rolls after completion of the rolling work. The technique adopted to mutually differentiate between the surface conditions of the respective surfaces of the metal sheet in contact with the pair of rolls is not specifically restricted but may be any technique of allowing the surfaces of the metal sheet in contact with the pair of rolls to have the mutually different surface conditions, for example, coating of an organic material like a fluororesin, plating, chemical conversion coating such as phosphate film forming, applying a powdery lubricant agent such as molybdenum disulfide, or surface treatment of the metal sheet. The phosphate film forming process is especially preferable for iron and steel sheets. One surface of the metal sheet in contact with the pair of rolls may be subjected to no treatment.

In still another preferable application, either of the first metal sheet rolling method and the second metal sheet rolling method according to the respective aspects of the invention discussed above may cause one interface out of the respective interfaces between the pair of rolls and the metal sheet to be not subjected to lubrication or surface treatment. This arrangement mutually differentiates between the frictions of the respective interfaces between the pair of rolls and the metal sheet to adopt the differential friction rolling technique, thus assuring the effects discussed above. This application of the metal sheet rolling method requires treatment of only one interface and is thus highly efficient from the viewpoints of both the time and the cost.

In another preferable application, either of the first metal sheet rolling method and the second metal sheet rolling method according to the respective aspects of the invention discussed above may cause at least one surface among two surfaces of the pair of rolls and two surfaces of the metal sheet in contact with the pair of rolls to be subjected to lubrication or surface treatment. This arrangement mutually differentiates between the frictions of the respective interfaces between the pair of rolls and the metal sheet to adopt the differential friction rolling technique, thus assuring the effects discussed above. The terminology 'surface treatment' hereof includes not only surface treatment other than lubrication but lubrication by surface treatment other than lubrication by coating of a liquid lubricant agent. The simple surface treatment effectively attains the mutual differentiation of the frictions of the respective interfaces between the pair of rolls and the metal sheet and thereby facilitates differential friction rolling. The differential friction rolling technique is readily performed by the simple surface treatment on at least one surface. In an embodiment of forming surface treatment layers on two or more surfaces among the four surfaces mentioned above, the respective surface treatment layers may be formed to have mutually different compositions or mutually different thicknesses.

According to still another aspect, the invention is further directed to a third metal sheet rolling method of rolling a metal sheet with a pair of rolls. The third metal sheet rolling method mutually differentiates between frictions of respective interfaces between the pair of rolls and the metal sheet and causing the pair of rolls to be made of mutually different materials. The application of the pair of rolls made of mutually different materials mutually differentiates between the surface conditions of the pair of rolls. This arrangement mutually differentiates between the frictions of the respective interfaces between the pair of rolls and the metal sheet to adopt the differential friction rolling technique, thus assuring the effects discussed above. The third metal sheet rolling method according to this aspect of the invention does not require any special treatment on the surfaces of the respective rolls and the metal sheet and thus ensures the differential friction rolling with the high efficiency. One typical example of the pair of rolls made of mutually different materials is a combination of a steel roll and a copper roll.

In one preferable application, any of the first metal sheet rolling method through the third metal sheet rolling method according to the respective aspects of the invention discussed above may use a rolling mill of rotating the pair of rolls at an identical speed. Any of the first metal sheet rolling method through the third metal sheet rolling method may be applied to a differential speed rolling mill but is preferably applicable to the inexpensive conventional rolling mill of rotating the pair of rolls at an identical speed to desirably give a rolled sheet with shear texture developed into the center of the sheet thickness.

In another preferable application any of the first metal sheet rolling method through the third metal sheet rolling method according to the respective aspects of the invention discussed above may warm-roll the metal sheet.

In any of the first metal sheet rolling method through the third metal sheet rolling method according to the respective aspects of the invention discussed above, it is preferable that an upper interface-lower interface differential static friction coefficient D is not less than 0.15. Here the upper interface-lower interface differential static friction coefficient is specified as the greater between an absolute value |p| of a difference 'p' by subtraction of a static friction coefficient of a lower surface of the metal sheet from a static friction coefficient of an upper surface of the metal sheet and an absolute value |q| of a difference 'q' by subtraction of a static friction coefficient of a lower roll from a static friction coefficient of an upper roll of the pair of rolls. The terminology 'static friction coefficient' hereof represents a coefficient of static friction to a predetermined material. This arrangement mutually differentiates between the frictions of the respective interfaces between the pair of rolls and the metal sheet to adopt the differential friction rolling technique, thus assuring the effects discussed above with the higher certainty. The predetermined material is not restricted but may be brass (by hard chromium treatment). It is preferable that the solid lubricant film has a static friction coefficient of not higher than 0.1.

According to another aspect, the invention is directed to a rolled sheet with a rolling texture of <111>//ND manufactured by the metal sheet rolling method having any of the applications and the arrangements discussed above. The rolled sheet according to this aspect of the invention is manufactured at a relatively low cost by the metal sheet rolling method of the invention. The rolled sheet has shear texture sufficiently developed into the center of the sheet thickness. Typical examples of the rolled sheet include aluminum alloy sheets with excellent deep drawability, magnesium alloy sheets with high ductility, copper alloy sheets with excellent bend formability, and magnetic steel sheets with excellent electromagnetic property.

DETAILED DESCRIPTION OF THE INVENTION

Figure 1:
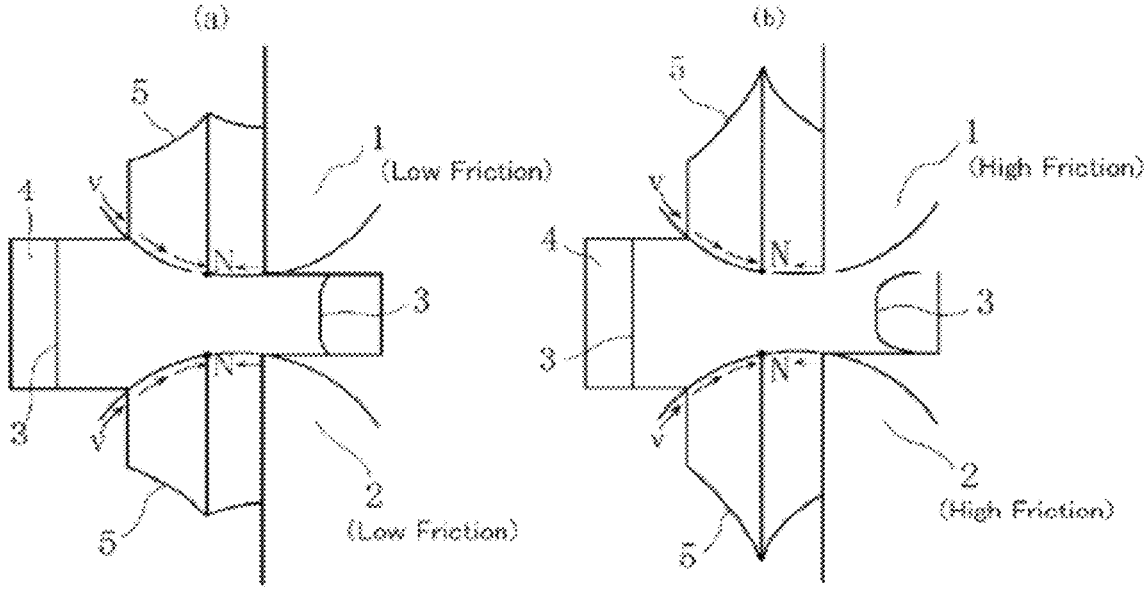
FIG. 1 is an explanatory view showing a pressure distribution and shear deformation by a symmetrical rolling technique.
Figure 2:
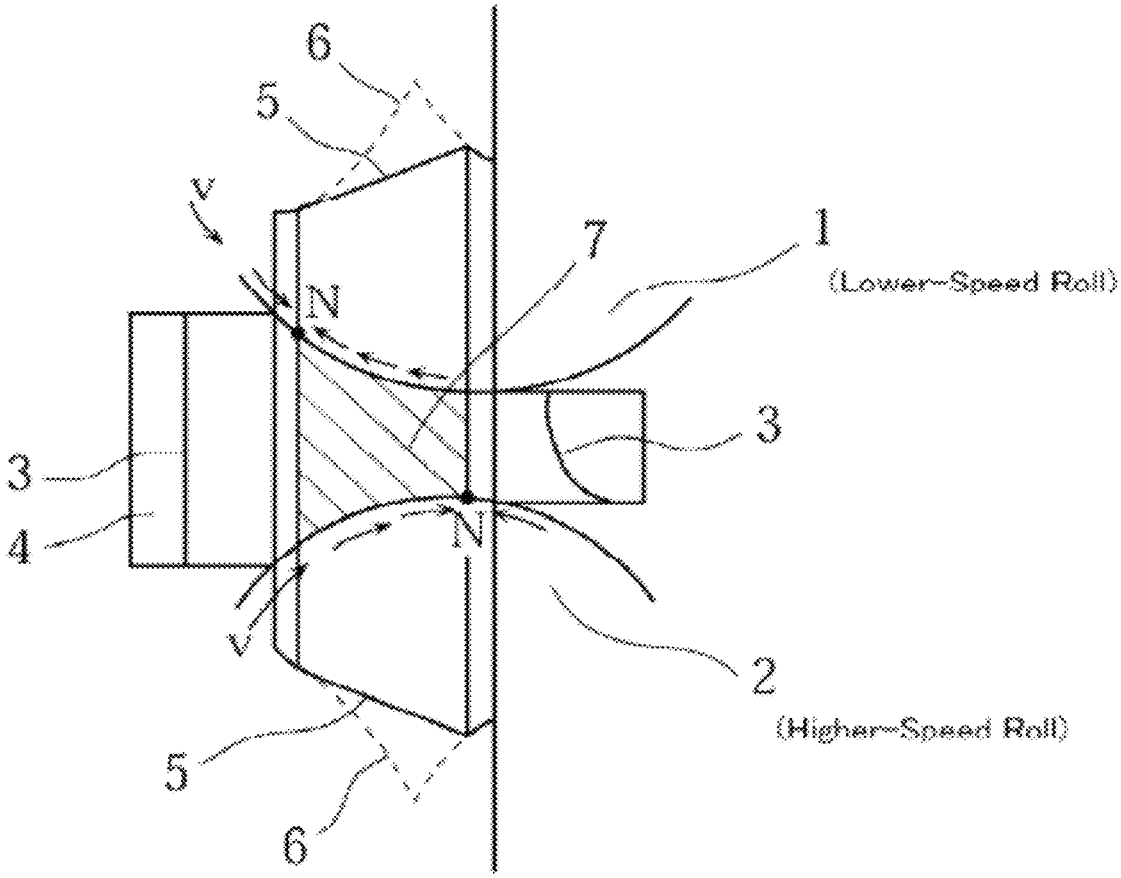
FIG. 2 is an explanatory view showing a pressure distribution and shear deformation by a differential speed rolling technique.
Figure 3:
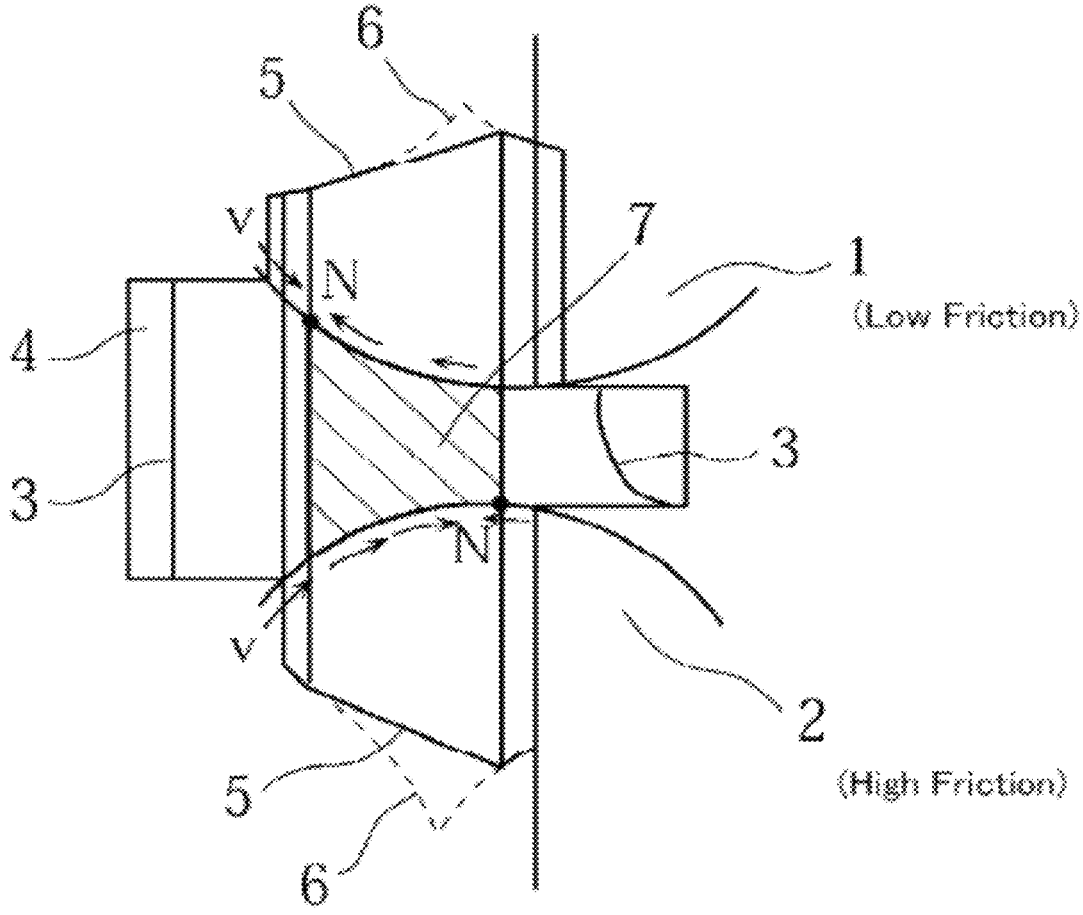
FIG. 3 is an explanatory view showing a pressure distribution and shear deformation by a differential friction rolling technique.

Some modes of carrying out the invention are described below as examples with reference to the accompanied drawings. The examples discussed below are to be considered in all aspects as illustrative and not restrictive in any sense. There may be many other modifications, changes, and alterations without departing from the scope or spirit of the main characteristics of the present invention.

EXAMPLES

1. Rolling Methods of Respective Working Examples and Comparative Examples

1-1. Rolling Methods of Working Examples 1 to 26

Commercially available industrial pure aluminum (A1050-O) sheets of 2.5 mm in sheet thickness, 30 mm in sheet width, and 300 mm in sheet length were provided as the metal sheet of the rolling object. For measurement of shear deformation introduced by rolling, an aluminum wire rod of 2 mm in diameter and 2.5 mm in height was embedded in advance in a direction of the sheet thickness at the center of the sheet width in each aluminum sheet. Diversity of solid lubricant films or surface treatment layers were formed on two interfaces between a pair of rolls and the aluminum sheet or on four surfaces of the pair of rolls and the aluminum sheet as shown in Working Examples 1 to 26 of Table 1. Each of the treated or untreated metal sheets was kept at 200° C. in an electric furnace for 10 minutes and was subjected to one-path rolling with a small-sized two-high rolling mill to reduce the sheet thickness to 50%. The rolling mill had one pair of working rolls of 130 mm in diameter. Both the rolls were driven at a peripheral speed of 2 m/min. The pair of working rolls were made of high carbon chromium ball-bearing steel (JIS G485 SUJ-2 class, hereafter referred to as SUJ). The metal sheet after rolling (rolled sheet) was kept at 400° C. in the electric furnace for 30 minutes and was annealed.

As shown in Table 1, Working Examples 1 through 4 and 9 through 12 formed solid lubricant films. Working Examples 1 and 9 sprayed a polytetrafluoroethylene resin (PTFE) lubricant agent (trade name: New TFE Coat manufactured by Fine Chemical Japan Co., Ltd.) as the solid lubricant agent and dried the sprayed solid lubricant agent at room temperature to coat the surfaces with fluororesin films. Working Examples 2 and 10 used a lubricant dispersion prepared by sufficiently dispersing SiC into a volatile solution as the solid lubricant agent to form solid lubricant films. Working Examples 3 and 11 used a lubricant dispersion prepared by sufficiently dispersing alumina into a volatile solution as the solid lubricant agent to form solid lubricant films. Working Examples 4 and 12 formed solid lubricant films by applying $MoS_2$ (molybdenum disulfide).

Working Examples 5 through 8 and 13 through 16 formed surface treatment layers, instead of the solid lubricant films. Working Examples 5 and 13 physically worked or buffed the surfaces to form surface treatment layers. Working Examples 7 and 15 roughened the surfaces by sandblasting to form surface treatment layers. Working Example 8 roughened the surfaces by wheel grinding to form surface treatment layers. Working Example 16 roughened the surfaces by fine knurling to form surface treatment layers. Working Example 6 smoothed the surfaces by TiC coating to form surface treatment layers. Working Example 14 smoothed the surfaces by hard chromium plating to form surface treatment layers.

Working Examples 17 and 19 formed films of graphite powder as solid lubricant films. Working Examples 18 and 20 roughened the surfaces with $CO_2$ (dry ice) to form surface treatment layers.

Working Examples 21, 22, and 24 through 26 formed solid lubricant films or surface treatment layers on two surfaces selected out of the total of the four surfaces of the pair of rolls and the metal sheet. Working Example 23 changed the material of the upper roll from SUJ to (polished) pure copper.

1-2. Rolling Methods of Working Examples 27 to 29

Working Examples 27 and 28 rolled the metal sheet in the same manner as those of Working Examples 1 through 26 with replacing the aluminum sheet by an AZ31B magnesium alloy sheet or a silicon steel sheet for the metal sheet and with embedding a magnesium wire rod in place of the aluminum wire rod for measurement of shear deformation. Working Example 29 rolled the metal sheet in the same manner as those of Working Examples 1 through 26 with replacing the aluminum sheet by an industrial beryllium copper alloy sheet (JIS H3130 C1720R) for the metal sheet, with embedding a pure copper wire rod in place of the aluminum wire rod for measurement of shear deformation, and with performing five paths of rolling at room temperature to reduce the sheet thickness by 70%.

TABLE 1

| | | Surface of Metal Plate | | | | | | | Surface of Rolls Upper Roll | | |
|---|---|---|---|---|---|---|---|---|---|---|---|
| | | | Upper Surface | | | Lower Surface | | | | | Friction |
| | | Material | Treatment | By | Friction Coefficient | Treatment | By | Friction Coefficient | Treatment | Composition | Coefficient |
| WORKING EXAMPLE | 1 | Al | SL*1 | Fluorine | 0.07 | U | — | 0.32 | — | SUJ*6 | 0.3 |
| | 2 | Al | SL | SiC | 0.08 | U | — | 0.32 | — | SUJ | 0.3 |
| | 3 | Al | SL | AP*4 | 0.08 | U | — | 0.32 | — | SUJ | 0.3 |
| | 4 | Al | SL | $MoS_2$ | 0.09 | U | — | 0.32 | — | SUJ | 0.3 |
| | 5 | Al | ST*2 | Buffing | 0.13 | U | — | 0.32 | — | SUJ | 0.3 |
| | 6 | Al | ST | TiC | 0.10 | U | — | 0.32 | — | SUJ | 0.3 |
| | 7 | Al | U*3 | — | 0.32 | ST | Sandblast | 0.48 | — | SUJ | 0.3 |
| | 8 | Al | U | — | 0.32 | ST | Griding | 0.51 | — | SUJ | 0.3 |
| | 9 | Al | U | — | 0.32 | U | — | 0.32 | SL | Fluorine | 0.07 |
| | 10 | Al | U | — | 0.32 | U | — | 0.32 | SL | SiC | 0.08 |
| | 11 | Al | U | — | 0.32 | U | — | 0.32 | SL | AP | 0.08 |
| | 12 | Al | U | — | 0.32 | U | — | 0.32 | SL | $MoS_2$ | 0.09 |
| | 13 | Al | U | — | 0.32 | U | — | 0.32 | ST | Buffing | 0.13 |
| | 14 | Al | U | — | 0.32 | U | — | 0.32 | ST | Cr Plating | 0.09 |
| | 15 | Al | U | — | 0.32 | U | — | 0.32 | — | SUJ | 0.3 |
| | 16 | Al | U | — | 0.32 | U | — | 0.32 | — | SUJ | 0.3 |
| | 17 | Al | SL | GP*5 | 0.18 | U | — | 0.32 | — | SUJ | 0.3 |
| | 18 | Al | U | — | 0.32 | ST | $CO_2$ Spray | 0.41 | — | SUJ | 0.3 |
| | 19 | Al | U | — | 0.32 | U | — | 0.32 | SL | GP | 0.18 |
| | 20 | Al | U | — | 0.32 | U | — | 0.32 | — | SUJ | 0.3 |
| | 21 | Al | SL | Fluorine | 0.07 | U | — | 0.32 | SL | SiC | 0.08 |
| | 22 | Al | U | — | 0.32 | ST | Sandblast | 0.48 | — | SUJ | 0.3 |

TABLE 1-continued

| | | | | | | | | | | |
|---|---|---|---|---|---|---|---|---|---|---|
| 23 | Al | U | — | 0.32 | U | — | 0.32 | — | Cu*7 | 0.15 |
| 24 | Al | SL | Fluorine | 0.07 | ST | $CO_2$ Spray | 0.41 | — | SUJ | 0.3 |
| 25 | Al | U | — | 0.32 | U | — | 0.32 | SL | Fluorine | 0.07 |
| 26 | Al | SL | Fluorine | 0.07 | U | — | 0.32 | — | SUJ | 0.3 |
| 27 | Mg | SL | Fluorine | 0.07 | U | — | 0.32 | — | SUJ | 0.3 |
| 28 | Fe | SL | Fluorine | 0.07 | U | — | 0.32 | — | SUJ | 0.3 |
| 29 | CuBe | SL | Fluorine | 0.07 | U | — | 0.32 | — | SUJ | 0.3 |

| | | Surface of Rolls Lower Roll | | | | | Evaluation of <111> | Performance |
|---|---|---|---|---|---|---|---|---|
| | | Treatment | Composition | Friction Coefficient | Friction Coefficient D | Shear Strain | Texture Formation | Evaluation of Rolled Plate |
| WORKING EXAMPLE | 1 | — | SUJ | 0.3 | 0.25 | 0.45 | ◎ | Accepted (1) |
| | 2 | — | SUJ | 0.3 | 0.24 | 0.45 | ◎ | Accepted (1) |
| | 3 | — | SUJ | 0.3 | 0.24 | 0.45 | ◎ | Accepted (1) |
| | 4 | — | SUJ | 0.3 | 0.23 | 0.44 | ◎ | Accepted (1) |
| | 5 | — | SUJ | 0.3 | 0.19 | 0.43 | ◎ | Accepted (1) |
| | 6 | — | SUJ | 0.3 | 0.22 | 0.44 | ◎ | Accepted (1) |
| | 7 | — | SUJ | 0.3 | 0.16 | 0.42 | ◎ | Accepted (1) |
| | 8 | — | SUJ | 0.3 | 0.19 | 0.42 | ◎ | Accepted (1) |
| | 9 | — | SUJ | 0.3 | 0.23 | 0.44 | ◎ | Accepted (1) |
| | 10 | — | SUJ | 0.3 | 0.22 | 0.43 | ◎ | Accepted (1) |
| | 11 | — | SUJ | 0.3 | 0.22 | 0.43 | ◎ | Accepted (1) |
| | 12 | — | SUJ | 0.3 | 0.21 | 0.42 | ◎ | Accepted (1) |
| | 13 | — | SUJ | 0.3 | 0.17 | 0.42 | ◎ | Accepted (1) |
| | 14 | — | SUJ | 0.3 | 0.21 | 0.41 | ◎ | Accepted (1) |
| | 15 | ST | Sandblast | 0.45 | 0.15 | 0.41 | ◎ | Accepted (1) |
| | 16 | ST | knurling | 0.49 | 0.19 | 0.42 | ◎ | Accepted (1) |
| | 17 | — | SUJ | 0.3 | 0.14 | 0.20 | ○ | Accepted (1) |
| | 18 | — | SUJ | 0.3 | 0.09 | 0.18 | ○ | Accepted (1) |
| | 19 | — | SUJ | 0.3 | 0.12 | 0.19 | ○ | Accepted (1) |
| | 20 | ST | $CO_2$ Spray | 0.41 | 0.11 | 0.19 | ○ | Accepted (1) |
| | 21 | — | SUJ | 0.3 | 0.25 | 0.44 | ◎ | Accepted (1) |
| | 22 | ST | Sandblast | 0.45 | 0.16 | 0.43 | ◎ | Accepted (1) |
| | 23 | — | SUJ | 0.3 | 0.15 | 0.41 | ◎ | Accepted (1) |
| | 24 | — | SUJ | 0.3 | 0.34 | 0.44 | ◎ | Accepted (1) |
| | 25 | ST | Sandblast | 0.45 | 0.38 | 0.42 | ◎ | Accepted (1) |
| | 26 | ST | $CO_2$ Spray | 0.41 | 0.25 | 0.41 | ◎ | Accepted (1) |
| | 27 | — | SUJ | 0.3 | 0.25 | 0.45 | ◎ | Accepted (2) |
| | 28 | — | SUJ | 0.3 | 0.25 | 0.45 | ◎ | Accepted (3) |
| | 29 | — | SUJ | 0.3 | 0.25 | 0.45 | ◎ | Accepted (4) |

*1SL: solid lubricant film,
*2ST: surface treatment layer,
*3U: untreated
*4AP: alumina powder,
*5GP: graphite powder,
*6SUJ: SUJ (base material),
*7Cu: polished pure Cu
<Performance Evaluation>
(1) r value,
(2) ductility,
(3) electromagnetic property,
(4) bend formability 1-3. Rolling Methods of Comparative Examples 1 to 6

The rolling methods of Comparative Examples 1 to 6 are shown in Table 2. Comparative Example 1 coated the upper surface and the lower surface of the metal sheet with solid lubricant films in the same manner as Working Example 1, while leaving the surfaces of the upper roll and the lower roll untreated. Comparative Example 2 left all the upper surface and the lower surface of the metal sheet and the surfaces of the upper roll and the lower roll untreated, while performing differential speed rolling with the upper roll peripheral speed of 2 m/min and the lower roll peripheral speed of 3 m/min. Comparative Example 3 left all the upper surface and the lower surface of the metal sheet and the surfaces of the upper roll and the lower roll untreated in the same manner as Comparative Example 2, while performing constant speed rolling with the upper roll peripheral speed and the lower roll peripheral speed of 2 m/min. In Comparative Examples 1 and 3, the friction of the interface between the upper surface of the metal sheet and the upper roll was accordingly equal to the friction of the interface between the lower surface of the metal sheet and the lower roll (vertically symmetrical rolling). For the purpose of comparison with Working Examples 28 and 29, Comparative Examples 4 through 6 performed vertically symmetrical rolling with replacing the aluminum sheet with a silicon steel sheet or an industrial beryllium copper alloy sheet for the metal sheet.

TABLE 2

| | | Surface of Metal Plate | | | | | | | Surface of Rolls | | |
|---|---|---|---|---|---|---|---|---|---|---|---|
| | | | | | | Lower Surface | | | Upper Roll | | |
| | | | Upper Surface | | | | | Friction | | | Friction |
| | | Material | Treatment | By | Friction Coefficient | Treatment | By | Coef-ficient | Treatment | Composition | Coef-ficient |
| COMPARATIVE EXAMPLE | 1 | Al | SL*1 | Fluorine | 0.07 | SL | Fluorine | 0.07 | — | SUJ*3 | 0.3 |
| | 2 | Al | U*2 | — | 0.32 | U | — | 0.32 | — | SUJ | 0.3 |
| | 3 | Al | U | — | 0.32 | U | — | 0.32 | — | SUJ | 0.3 |
| | 4 | Fe | SL | Fluorine | 0.07 | SL | Fluorine | 0.07 | — | SUJ | 0.3 |
| | 5 | CuBe | U | — | 0.32 | U | — | 0.32 | — | SUJ | 0.3 |
| | 6 | CuBe | SL | Fluorine | 0.07 | SL | Fluorine | 0.07 | — | SUJ | 0.3 |

| | | Surface of Rolls Lower Roll | | | | Evaluation of <111> | | Performance |
|---|---|---|---|---|---|---|---|---|
| | | Treatment | Composition | Friction Coefficient | Friction Coefficient D | Shear Strain | Texture Formation | Evaluation of Rolled Plate |
| COMPARATIVE EXAMPLE | 1 | — | SUJ*3 | 0.3 | 0 | 0 | X | Rejected (1) |
| | 2 | — | SUJ | 0.3 | Differential Speed Rolling | 0.4 | ◎ | Accepted (1) |
| | 3 | — | SUJ | 0.3 | 0 | 0 | X | Rejected (1) |
| | 4 | — | SUJ | 0.3 | 0 | 0 | X | Rejected (1) |
| | 5 | — | SUJ | 0.3 | 0 | 0 | X | Rejected (3) |
| | 6 | — | SUJ | 0.3 | 0 | 0 | X | Rejected (4) |

*1SL: solid lubricant film,
*2U: untreated
*3SUJ: SUJ (base material)
<Performance Evaluation>
(1) r value,
(2) ductility,
(3) electromagnetic property,
(4) bend formability

2. Evaluations of Respective Working Examples and Comparative Examples

The rolled sheets of Working Examples 1 through 29 and the rolled sheets of Comparative Examples 1 through 6 were evaluated for the performance (for example, the r value), the shear strain, the average grain size, the texture formation, and the upper interface-lower interface differential static friction coefficient D as discussed below in detail.

2-1. Evaluation of Performance

The performance of each of Working Examples 1 to 26 and Comparative Examples 1 to 3 using the aluminum sheet as the metal sheet was evaluated by the r value. A tensile test specimen including a parallel section of 10 mm in length and 5 mm in width was cut out from each annealed sheet of Working Example 1 and Comparative Examples 1 and 2. The tensile test specimen was pulled with a material testing mill at a rate of 0.5 mm/min to give an elongation of 15% to 20%, and the r value was measured. The r value was similarly measured for the respective annealed sheets of Working Examples 2 to 26 and Comparative Examples 3 and 4. The results of the measurement are shown in Tables 1 and 2. As the criterion, the deep drawability (r value) of a conventionally worked aluminum sheet annealed after vertically symmetrical rolling was set equal to 100. Each rolled sheet with an improvement of the r value by at least 3% from the r value of the conventional rolled sheet was evaluated as 'accepted', while each rolled sheet with an improvement of the r value by less than 3% was evaluated as 'rejected'. The evaluation results of the r value are shown in the 'performance evaluation of rolled sheet' column in Tables 1 and 2. As clearly seen from Tables 1 and 2, Working Examples 1 to 26 and Comparative Example 2 (differential speed rolling) were 'accepted', and Comparative Examples 1 and 3 were 'rejected'. These results prove improvement in press formability of the aluminum alloy sheet by the differential friction rolling technique. This is ascribed to the dependency of the r value on the texture and the enhancement of the r value by the shear texture of a material having fcc (face-centered cubic lattice) structure.

The performance of Working Example 27 using the magnesium alloy sheet as the metal sheet was evaluated by the ductility of a tensile test (in conformity with Japanese Industrial Standards Z2241). Each rolled sheet was evaluated as 'accepted' or 'rejected' by an improvement of the ductility by at least 3% or by less than 3% from the ductility of the conventional rolled sheet. As clearly seen from Table 1, Working Example 27 was 'accepted'.

The performance of each of Working Example 28 and Comparative Example 4 using the silicon steel sheet as the metal sheet was evaluated by hysteresis measurement (in conformity with Japanese Industrial Standards C2502) and an iron loss test (in conformity with Japanese Industrial Standards C2550). Each rolled sheet was evaluated as 'accepted' or 'rejected' by an improvement of the properties by at least 3% or by less than 3% from the ductility of the conventional rolled sheet. As clearly seen from Tables 1 and 2, Working Example 28 was 'accepted', and Comparative Example 4 was 'rejected'.

Figure 4:
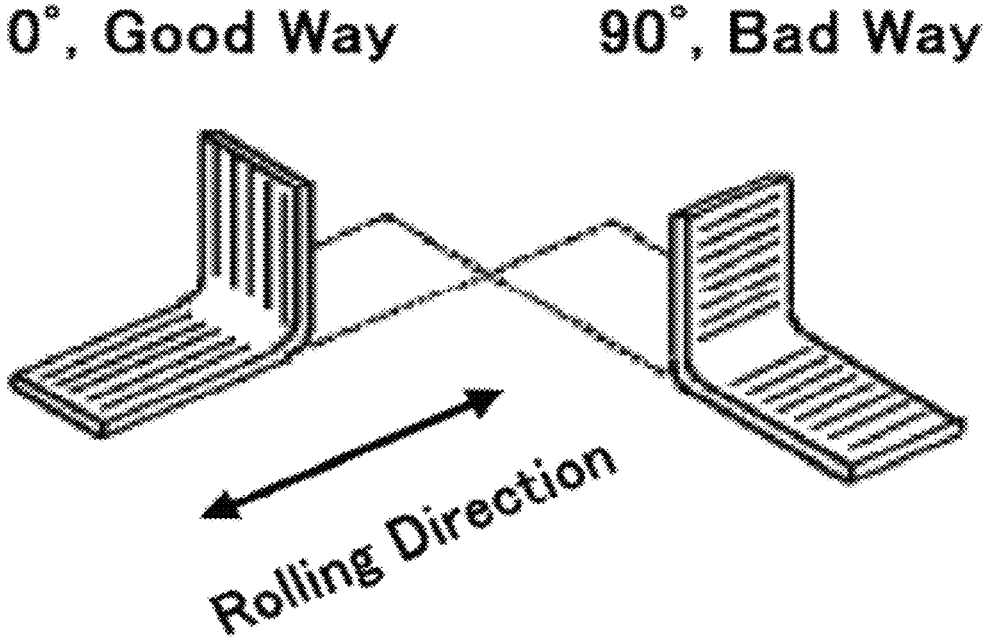
FIG. 4 is an explanatory view showing a flexural resistance test of industrial beryllium copper sheets.

The performance of each of Working Example 29 and Comparative Examples 5 and 6 using the beryllium copper sheet as the metal sheet was evaluated by the bend formability. Each test specimen was obtained by making a rolled sheet sequentially subjected to solution heat treatment (800° C.×1 minute) to adjust the crystal grain size to approximately 10 μm, finishing rolling (at room temperature, constant-speed lubrication rolling, rolling reduction rate of 9%), and aging treatment (300° C.×40 minutes) to adjust the material strength to the hardness of 300 Hv. For evaluation of the bend formability, the test specimen was bent to a V shape according to the V block method (in conformity with Japanese Industrial Standards Z2248) of a metal material bending test. A ratio (R/t) of an inner vending radius (R) of the test specimen with no bending crack to a sheet thickness (t) of the test specimen was used as the criterion of the evaluation. The smaller R/t value gives the higher bend formability. The bending directions were a 0-degree direction (good way) and a 90-degree direction (bad way) relative to the rolling direction as shown in FIG. 4. The R/t values of Working Example 29 in both the directions were approximately 60 through 70% of the R/t values of Comparative Examples 5 and 6. Namely Working Example 29 had the high bend formability. The enhanced bend formability is ascribed to development of the shear texture into the sheet throughout the thickness of the rolled sheet by the rolling technique of the invention. Such enhanced bend formability is not characteristic of beryllium copper sheets, but the similar effects are expected for copper sheets and copper alloy sheets having the similar fcc (face-centered cubic lattice) structure.

2-2. Evaluation of Shear Strain

Figure 5:
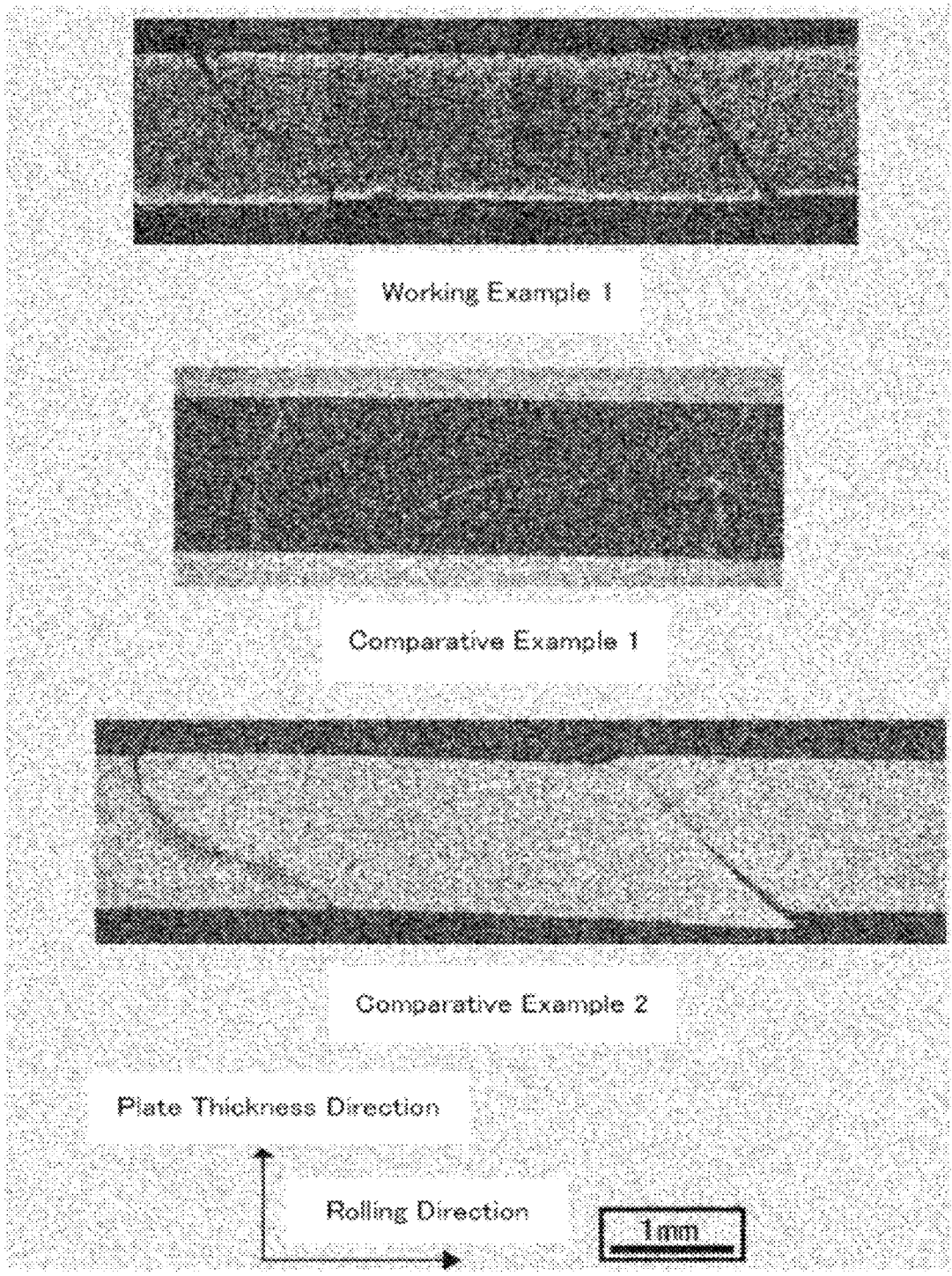
FIG. 5 is optical microscopic photographs showing the post-rolling state of a wire rod embedded at the center of the sheet width of each industrial pure aluminum metal sheet in Working Example 1 and Comparative Examples 1 and 2.
Figure 6:
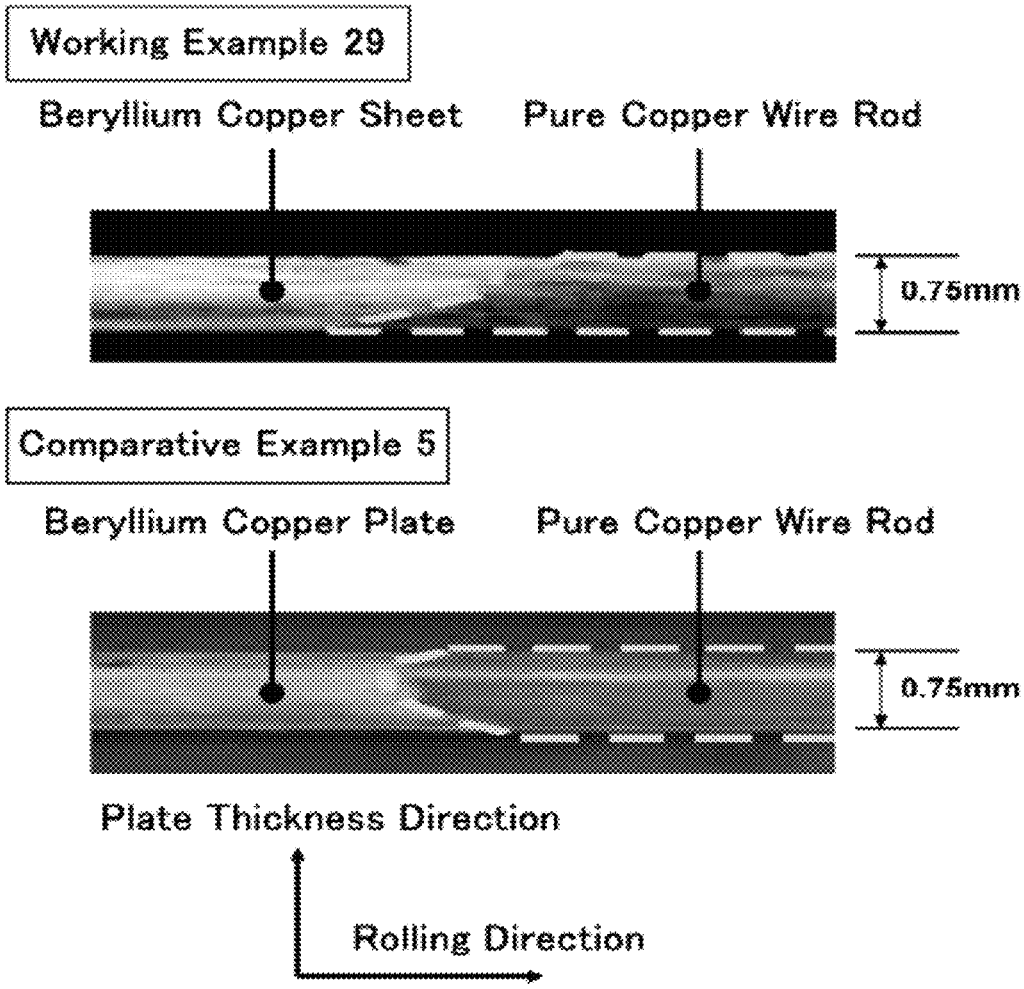
FIG. 6 is optical microscopic photographs showing the post-rolling state of a wire rod embedded at the center of the sheet width of each industrial beryllium copper sheet in Working Example 29 and Comparative Example 5.

Each metal sheet of Working Example 1 and Comparative Examples 1 and 2 was cut at the center of the sheet width, and the embedded wire rod was observed with an optical microscope. The optical photomicrographs of Working Example 1 and Comparative Examples 1 and 2 are shown in FIG. 5. The shear strain introduced by each rolling was determined from the observed slope of the wire rod at the center of the sheet width. The shear strain was similarly determined for Working Examples 2 to 29 and Comparative Examples 3 to 6. The optical photomicrographs of Working Example 29 and Comparative Example 5 are shown in FIG. 6. The results of the evaluation are shown in Tables 1 and 2.

Deformations of pre-embedded aluminum wire rods by rolling are shown in the optical photomicrographs of FIG. 5. In the optical photomicrograph of Working Example 1, the non-lubricated lower surface is advanced from the upper surface lubricated by fluorine treatment. This shows introduction of shear deformation. The optical photomicrograph of Comparative Example 1 has only a small slope of the wire rod, which shows introduction of substantially no shear deformation. In the optical photomicrograph of Comparative Example 2 the surface of the higher-speed roll is advanced from the surface of the lower-speed roll. This shows introduction of shear deformation. The slope of the wire rod at the center of the sheet thickness in Comparative Example 2 is substantially equivalent to the slope in Working Example 1. Comparative Example 2 has a significant slope of the wire rod on the side of the higher-speed roll, while Working Example 1 has a substantially uniform slope of the wire rod over the whole sheet thickness.

Deformations of pre-embedded pure copper wire rods by rolling are shown in the optical photomicrographs of FIG. 6. Shear deformation is observed over the whole sheet thickness in the optical photomicrograph of Working Example 29. Typical compressive rolled deformation having vertical inversion of the direction of shear deformation at the center of the sheet thickness with no shear deformation is observed in the optical photomicrograph of Comparative Example 5. Comparative Example 5 has some shear deformation in the shallow surfaces under the slight influence of friction. The degree of shear deformation is, however, very low, and the coverage of shear deformation from the surface toward the center of the sheet thickness is very narrow. Comparative Example 6 gave the similar result to that of Comparative Example 5, although not being specifically illustrated.

2-3. Evaluation of Average Grain Size

The average intercept length of recrystallized grains in each annealed sheet of Working Example 1 and Comparative Examples 1 and 2 was measured as the average grain size. The measured average intercept length was 64 μm in Working Example 1, 85 μm in Comparative Example 1, and 62 μm in Comparative Example 2. All the annealed sheets of Working Example 1 and Comparative Examples 1 and 2 had optical microstructures of equiaxed recrystallized grains. The average grain size of Working Example 1 given by the average intercept length is smaller than that of Comparative Example 1 and is substantially equivalent to that of Comparative Example 2. This proves that the differential friction rolling technique has the refinement effect of crystallized grains.

2-4. Evaluation of Texture Formation

Figure 7:
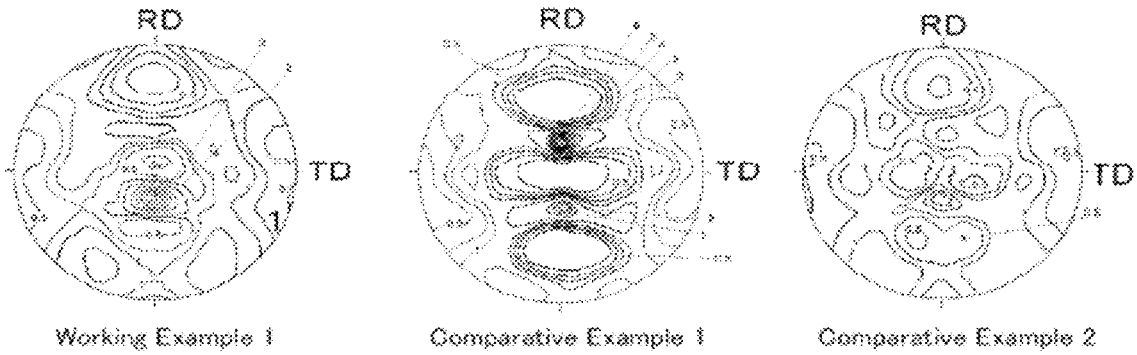
FIG. 7 is {111} pole figures of the industrial pure aluminum metal sheets obtained in Working Example 1 and Comparative Examples 1 and 2.

The pole figures of the rolled sheets (aluminum) in Working Example 1 and Comparative Examples 1 and 2 were measured by X-ray diffractometry. The {111} pole figures of the rolled sheets are shown in FIG. 7. According to the {111} pole figures of the rolled sheets in FIG. 7, Working Example 1 and Comparative Example 2 give not the conventional rolling texture but the asymmetrical shear textures in the sheet width direction (<111>//ND rolling textures) while Comparative Example 1 gives the typical pure metal-type rolling texture. Based on the pattern difference of these pole figures, the texture formation was evaluated for Working Examples 2 to 28 and Comparative Examples 3 and 4. The results of the evaluation are shown in Tables 1 and 2. The symbols 'double circle', 'open circle', 'cross' respectively represent the similar pattern to that of Working Example 1, the relatively similar pattern to that of Working Example 1 with the lower integration of contour lines and some disorder of the pattern, and the pattern significantly different from that of Working Example 1 but similar to that of Comparative Example 1. Working Examples 2 to 16 and 21 to 28 and Comparative Example 2 were evaluated as the 'double circle', Working Examples 17 to 20 as the 'open circle', and Comparative Examples 1, 3, and 4 as the 'cross'. This shows formation of the favorable textures in Working Examples 2 to 28.

Figure 8:
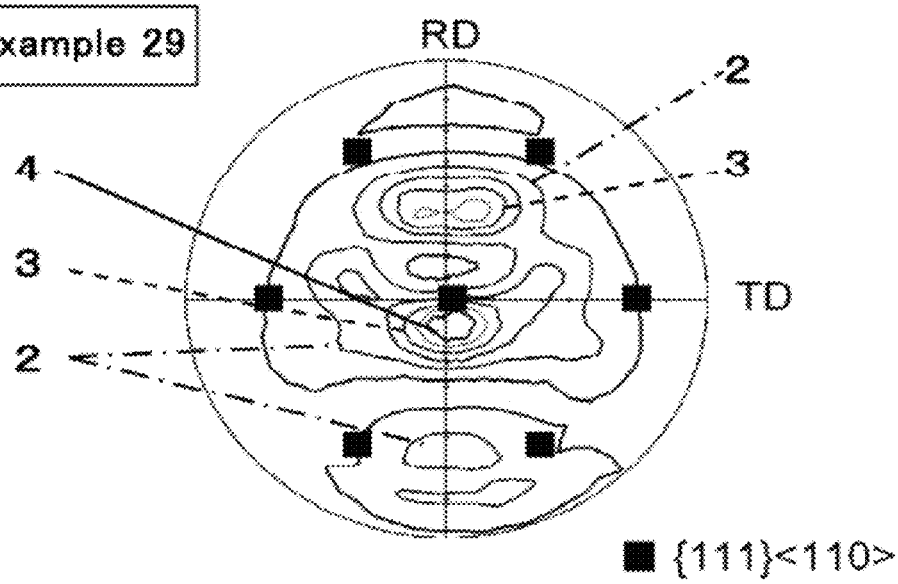
FIG. 8 is {111} pole figures of the industrial beryllium copper sheets obtained in Working Example 29 and Comparative Example 5.
Figure 8:
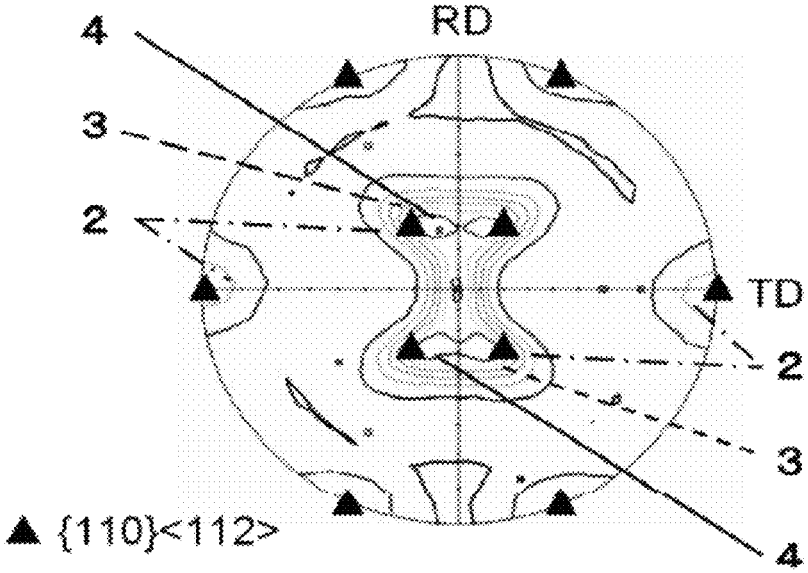

The {111} pole figures of the rolled sheets (beryllium copper sheets) in Working Example 29 and Comparative Example 5 are shown in FIG. 8. According to the {111} pole figures of the rolled sheets in FIG. 8, Working Example 29 gives the rolling texture with shear deformation, while Comparative Example 5 has the significantly different rolling texture generally known as the brass-type rolling texture.

2-5. Evaluation of Upper Interface-Lower Interface Differential Static Friction Coefficient D The upper interface-lower interface differential static friction coefficient D was calculated for Working Examples 1 to 29 and Comparative Examples 1 to 6. The upper interface-lower interface differential static friction coefficient D was specified as the greater between an absolute value |p| of a difference 'p' by subtraction of a static friction coefficient of the lower surface of the metal sheet from a static friction coefficient of the upper surface of the metal sheet and an absolute value |q| of a difference 'q' by subtraction of a static friction coefficient of the lower roll from a static friction coefficient of the upper roll. Each surface with a solid lubricant film formed thereon or each surface with a surface treatment layer formed thereon was measured with a friction meter (trade name: portable friction meter HEIDON Tribogear Muse TYPE 94i II manufactured by Shinto Scientific Co., Ltd). The measured value was adopted as the static friction coefficient of each surface. Brass (hard chromium-treated) was adopted for the counter material (slider). The concrete calculation of the upper interface-lower interface differential static friction coefficient D is given below for Working Examples 1 and 21:

$$p=0.07-0.32=-0.25, |p|=0.25, q=0.3-0.3=0|q|=0, |p|>|q|, D=0.25 \quad \text{Working Example 1}$$

$$p=0.07-0.32=-0.25, |p|=0.25, q=0.08-0.32=-0.24, |q|=0.24, |p|>|q|, D=0.25 \quad \text{Working Example 21}$$

According to the optical photomicrographs of FIGS. 5 and 6 and Tables 1 and 2, differentiation of the frictional force between the upper interface and the lower interface leads to the introduction of shear deformation and the resulting formation of the rolling texture of <111>//ND in Working Examples 1 to 29. The rolled sheets having the upper interface-lower interface differential static friction coefficient D of not less than 0.15 (Working Examples 1 to 16 and 21 to 29) give the favorable rolling textures, compared with the rolled sheets having the upper interface-lower interface differential static friction coefficient D of less than 0.15 (Working Examples 17 to 20). The shear strains of these Working Examples are substantially equivalent to the shear strain of Comparative Example 2 adopting the differential speed rolling technique. In the case of surface lubrication by formation of a solid lubricant film, in order to give the favorable shear strain, it is preferable that the slid lubricant film has the static friction coefficient of not higher than 0.1. According to Table 1, Working Example 1 with the film on the upper surface of the metal sheet having the static friction coefficient of 0.07 shows the better shear strain than Working Example 17 with the film having the static friction coefficient of 0.18.

2-6. Summary of Evaluations

These test results of Working Examples 1 through 29 prove the introduction of shear deformation deep into the center of the sheet thickness of each rolled sheet and the sufficient development of shear texture in the rolled sheet by application of even the conventional rolling mill of rotating the upper roll and the lower roll at an identical speed. Rolled sheets, such as aluminum alloy sheets with excellent formability (deep drawability), magnesium alloy sheets with high ductility, copper alloy sheets with excellent bend formability, and magnetic steel sheets with excellent electromagnetic property are obtainable without any significant cost increase. In Working Examples 21, 22, and 24 through 26, the solid lubricant film or the surface treatment layer was formed on two the surfaces among the total of four surfaces of the rolls and the metal sheet. Working Examples 21, 22, and 24 through 26 accordingly had the higher cost than the other Working Examples.

The present application claims the priority based on Japanese Patent Application No. 2007-047158 filed on Feb. 27, 2007, the disclosure of which is hereby incorporated by reference in its entirety.

INDUSTRIAL APPLICABILITY

The principle of the present invention is preferably applicable to metal sheet rolling.

What is claimed is:

1. A metal sheet rolling method of rolling a metal sheet with a pair of rolls, the metal sheet rolling method mutually differentiating between frictions of respective interfaces between the pair of rolls and the metal sheet and lubricating at least one of the interfaces by a procedure other than lubrication by coating of a liquid lubricant agent, wherein an upper interface-lower interface differential static friction coefficient D is not less 0.15, the upper interface-lower interface differential static friction coefficient being specified as the neater between an absolute value |p| of a difference 'p' by subtraction of a static friction coefficient of a lower surface of the metal sheet from a static friction coefficient of an upper surface of the metal sheet and an absolute value |q| of a difference 'q' by subtraction of a static friction coefficient of a lower roll from a static friction coefficient of an upper roll of the pair of rolls, where the static friction coefficient represents a coefficient of static friction to a predetermined material.

2. The metal sheet rolling method in accordance with claim 1, wherein the procedure other than lubrication by coating of the liquid lubricant agent is lubrication by film forming of a solid lubricant agent.

3. The metal sheet rolling method in accordance with claim 2, wherein the solid lubricant agent is a fluororesin lubricant agent.

4. A metal sheet rolling method of rolling a metal sheet with a pair of rolls, the metal sheet rolling method mutually differentiating between frictions of respective interfaces between the pair of rolls and the metal sheet and making at least one of the interfaces subjected to surface treatment by a procedure other than lubrication, wherein an upper interface-lower interface differential static friction coefficient D is not less than 0.15, the upper interface-lower interface differential static friction coefficient being specified as the greater between an absolute value |p| of a difference 'p' by subtraction of a static friction coefficient of a lower surface of the metal sheet from a static friction coefficient of an upper surface of the metal sheet and an absolute value |q| of a difference 'q' by subtraction of a static friction coefficient of a lower roll from a static friction coefficient of an upper roll of the pair of rolls, where the static friction coefficient represents a coefficient of static friction to a predetermined material.

5. The metal sheet rolling method in accordance with claim 1, the metal sheet rolling method mutually differentiating between surface conditions of the pair of rolls.

6. The metal sheet rolling method in accordance with claim 1, the metal sheet rolling method mutually differentiating between surface conditions of respective surfaces of the metal sheet in contact with the pair of rolls.

7. The metal sheet rolling method in accordance with claim 1, wherein the metal sheet rolling method causing one interface out of the respective interfaces between the pair of rolls and the metal sheet to be not subjected to lubrication or surface treatment.

8. The metal sheet rolling method in accordance with claim 1, the metal sheet rolling method causing at least one surface among two surfaces of the pair of rolls and two surfaces of the metal sheet in contact with the pair of rolls to be subjected to lubrication or surface treatment.

9. A metal sheet rolling method of rolling a metal sheet with a pair of rolls, the metal sheet rolling method mutually differentiating between frictions of respective interfaces between the pair of rolls and the metal sheet and causing the pair of rolls to be made of mutually different materials, wherein an upper interface-lower interface differential static friction coefficient D is not less than 0.15, the upper interface-lower interface differential static friction coefficient being specified as the greater between an absolute value |p| of a difference 'p' b subtraction of a static friction coefficient of a lower surface of the metal sheet from a static friction coefficient of an upper surface of the metal sheet and an absolute value |q| of a difference 'q' by subtraction of a static friction coefficient of a lower roll from a static friction efficient of an upper roll of the pair of rolls, where the static friction coefficient represents a coefficient of static friction to a predetermined material.

10. The metal sheet rolling method in accordance with claim 1, the metal sheet rolling method using a rolling mill of rotating the pair of rolls at an identical speed.

11. The metal sheet rolling method in accordance with claim 1, the metal sheet rolling method warm-rolling the metal sheet.

12. The metal sheet rolling method in accordance with claim 4, the metal sheet rolling method mutually differentiating between surface conditions of the pair of rolls.

13. The metal sheet rolling method in accordance with claim 4, the metal sheet rolling method mutually differentiating between surface conditions of respective surfaces of the metal sheet in contact with the pair of rolls.

14. The metal sheet rolling method in accordance with claim 4, wherein the metal sheet rolling method causing one interface out of the respective interfaces between the pair of rolls and the metal sheet to be not subjected to lubrication or surface treatment.

15. The metal sheet rolling method in accordance with claim 4, the metal sheet rolling method causing at least one surface among two surfaces of the pair of rolls and two surfaces of the metal sheet in contact with the pair of rolls to be subjected to lubrication or surface treatment.

16. The metal sheet rolling method in accordance with claim 4, the metal sheet rolling method using a rolling mill of rotating the pair of rolls at an identical speed.

17. The metal sheet rolling method in accordance with claim 9, the metal sheet rolling method using a rolling mill of rotating the pair of rolls at an identical speed.

18. The metal sheet rolling method in accordance with claim 4, the metal sheet rolling method warm-rolling the metal sheet.

19. The metal sheet rolling method in accordance with claim 9, the metal sheet rolling method warm-rolling the metal sheet.

* * * * *